United States Patent [19]

Salman

[11] 4,297,197

[45] Oct. 27, 1981

[54] ELECTROPLATING RACK

[75] Inventor: Syed Salman, Sterling Heights, Mich.

[73] Assignee: International Telephone and Telegraph Corp., New York, N.Y.

[21] Appl. No.: 206,400

[22] Filed: Nov. 13, 1980

[51] Int. Cl.[3] ..... C25D 17/08

[52] U.S. Cl. ..... 204/297 W; 204/285

[58] Field of Search ..... 204/285, 297 R, 297 W, 204/297 M

[56] References Cited

U.S. PATENT DOCUMENTS

| | | | |
|---|---|---|---|
| 3,655,549 | 4/1972 | Wild | 204/297 R |
| 3,671,416 | 6/1972 | Belke | 204/297 W |
| 4,100,054 | 7/1978 | DuRocher | 204/297 W |
| 4,176,039 | 11/1979 | Wismer | 204/297 W |

FOREIGN PATENT DOCUMENTS

| | | | |
|---|---|---|---|
| 465343 | 5/1950 | Canada | 204/297 W |
| 1079916 | 4/1960 | Fed. Rep. of Germany | 204/297 W |
| 1582003 | 9/1969 | France | 204/297 W |

*Primary Examiner*—F. Edmundson

*Attorney, Agent, or Firm*—James B. Raden; Harold J. Holt

[57] ABSTRACT

A metal electroplating rack coated with an insulating coating. The extremities of the rack has tips which are uncoated to provide electrical contact for a part being plated. The portion of the rack adjacent the tips has at least one opening through the rack, the opening being coated with an insulating coating such that a continuous coating is formed with the coating on opposite surfaces of the rack so as to prevent loss of adhesion of the insulating coating at the tip.

6 Claims, 4 Drawing Figures

ELECTROPLATING RACK

This invention relates to an electroplating rack and specifically to a metal electroplating rack having an insulating coating thereon.

Electroplating racks are widely used in the plating of both metals and plastics. Such racks, or jigs as they are sometimes referred to, are used for suspending the components to be plated in an electroplating vat. The rack must be electrically conductive and hence the material of construction of such racks is an electrically conductive metal. In order to prevent plating on the racks, they are frequently coated with a non-conductive insulating coating. However, in order to provide electrical contact with the part being plated, the insulating coating is usually removed at the tips of the racks.

The insulating coating-metal interface, exposed during the tip baring operation, becomes susceptible to attack by the plating solution. With repeated rack use, the coating loses adhesion at the metal interface thus exposing the metal surface to chemical attack and excessive plate build-up. The build-up can also give roughness of plate on the parts during subsequent operation. Racks with loss of adhesion of insulating coating at the tips must accordingly be stripped and recoated.

It is a primary object of the present invention to provide a simple and convenient means of improving the adhesion of insulating coatings at the tips of electroplating racks.

It is an additional object of this invention to provide a bridge across the extremity of the rack to the coatings on opposite surfaces of the rack in order to considerably enhance rack coating life.

The foregoing and other objects of the invention are accomplished by providing at least one opening through the rack in the portion of the rack adjacent the tip. The opening is coated with insulating coating to form a continuous coating with the coating on opposite surfaces of the rack. Specifically, the invention comprises an electroplating rack composed of an electrically conductive metal coated with an insulating coating, the rack having tips at extremities thereof, the tips being uncoated to provide electrical contact for a part being plated. The portion of the rack adjacent the tip has at least one opening therein through the rack, the opening being coated with the insulating coating such that a continuous coating is formed with the coating on the opposite surfaces of said portion of the rack.

Figure 1:
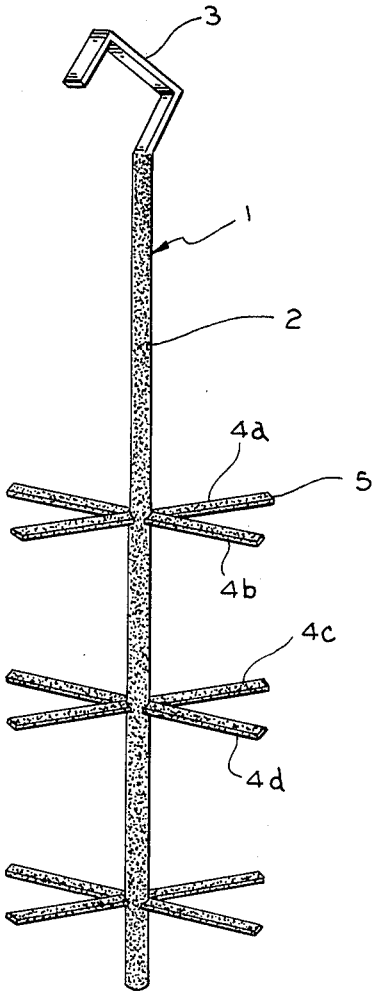
Figure 2:
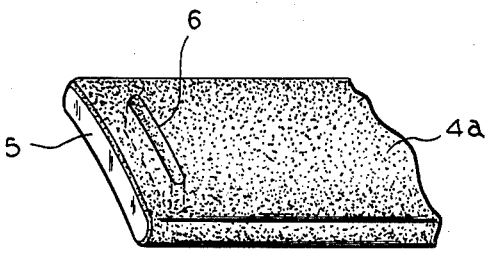
Figure 3:
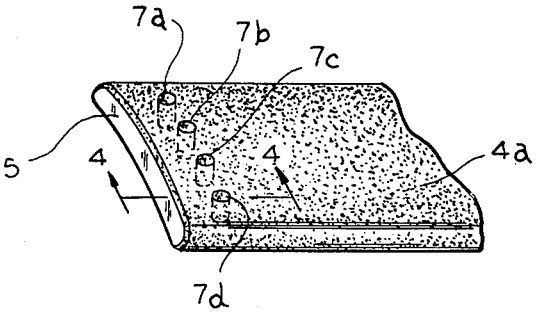
Figure 4:
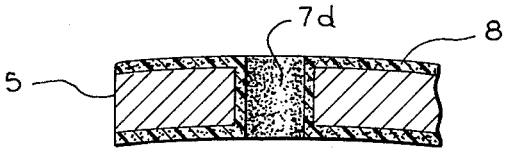

The invention will be better understood by reference to the accompanying drawing in which FIG. 1 is a perspective view of a typical rack with which the invention is useful, FIG. 2 is an enlarged perspective view of the tip and adjacent portion of a crossbar of the rack of FIG. 1 showing one embodiment of the invention, FIG. 3 is a view similar to that of FIG. 2 showing a second embodiment of the invention, and FIG. 4 is a crosssectional view of the tip of the rack taken along the lines 4—4 of FIG. 3.

There are two types of electroplating racks in common use—the frame type and single spline. More complete descriptions of such racks may be found at various places in the literature, for example, in the publication, *Plating,* Apr. 1970, pages 372–374 and in *Metal Finishing Guidebook and Directory,* published by Metals Plastics Publication, Inc., 1974. The drawing illustrates the use of the invention in connection with a single spline rack.

It will be understood however that it is equally useful with other types of electroplating racks.

FIG. 1 shows a single spline electroplating rack 1 having a spline 2, a hook 3 for contact with a cathode bar and a series of rack crossbars 4*a*, 4*b*, 4*c* and 4*d* joined in pairs at their midpoints to the spline. At the extremity of each crossbar is a tip 5 which provides electrical contact to the part being plated.

The main body of the rack is an electrically conductive metal such as copper, aluminum, brass, nickel, phosphor bronze, steel or titanium. The rack hook is best constructed as a continuation of the spline and should be of the same high conductivity metal. The crossbars should also be highly conductive and may be bolted or riveted, to the spline and also soldered to insure passage of current. The tip is frequently stainless steel or titanium for corrosion resistance but may also be copper or other high conductivity metal.

The electroplating process requires an electrically conductive surface on the part being plated. Since plastic parts are non-conductors, the surface of the part must first be etched and chemically pre-plated. Metal parts also require surface preparation operations. All of these operations require that the rack carrying the parts be dipped in a series of tanks containing acids, accelerators, catalysts and plating solutions. If bare, the rack metal would itself get plated in these various pre-plating and plating operations and during successive cycles would develop an excessive build-up of plating. This would restrict the utility of the rack and would also contaminate the various solution baths. In order to avoid these problems, the racks are coated with an insulating coating, usually a plasticized polyvinyl chloride resin, commonly referred to as a "plastisol". A plastisol is a viscous dispersion of the resin in a plasticizer that produces a fluid mixture which may range in viscosity from a pourable liquid to a heavy paste.

After coating the racks, the plastisol coating of tip 5 on each crossbar is removed to provide electrical contact to the part being plated. As previously indicated, the plastisol-metal interface exposed during the tip baring operation becomes susceptible to attack by the plating solutions. With repeated rack use, the plastisol loses adhesion at the metal interface on the tip thus exposing the metal surface for chemical attack. The plating solution also becomes contaminated and there is excessive plate build-up at the tip.

In accordance with the present invention, prior to coating the rack with the insulating coating, one or more openings are made through the portion of the rack adjacent the tips. This can take the form of an elongated slot 6 shown in FIG. 2 of the drawing or a series of holes 7*a*, 7*b*, 7*c* and 7*d* shown in FIG. 3 and in crosssection in FIG. 4. The slot or holes are drilled across the contact material of the crossbars 4*a*, 4*b*, 4*c*, and 4*d* adjacent and as close as possible to the tip 5 without structurally impairing the strength of the tip. Normally, the opening will be from 1/16" to ¼" from the tip. The diameter of the hole or width of the slot will normally vary from 1/32" to ½" but could be less or more depending on the metal thickness and width of the crossbar or other holding member. The holes may be spaced from ¼" to ½" apart but again this distance will vary depending on hole diameter and width of the crossbar. The number of holes will also depend on the width and strength of the crossbar or other holding member and the current bearing capability of the rack material.

After the holes, slots or other shaped openings are drilled or otherwise formed in the crossbars, the racks are coated in conventional fashion with a plastisol coating 8. The following is a typical description of such a coating procedure.

The rack is first sand or grit blasted to provide a rough or course surface. A solvent-based primer is then applied. The primer, applied in order to get optimum adhesion of the plastisol coating to the rack, is either sprayed, dip-coated, or applied by a brush. The primer coated rack is air-dried for 15 minutes and baked at 360°-500° F. for 5 to 45 minutes depending upon the metal mass and oven efficiency. While the metal is hot, it is dipped into a bath of plastisol. In order to obtain sufficient coating thickness free of pits and voids, the racks are dipped more than once in the plastisol coating. Between each dipping operation, they are cured in an oven for 5 minutes at 350°-375° F. After the required thickness is obtained, the coating is cured at 370°-400° F. for 30 minutes to several hours depending on the thickness of the coat and the oven efficiency. The coating thickness of racks may vary from 75 mils to an inch or more. The entire rack, with the exception of hook 3, is coated. After the rack is coated, the plastisol coating covering the tips is removed to expose the electrical contacts. The tip may be bared from the coating by mechanical means such as a rotary blade saw or a grinder. During the plastisol coating operation, the plastisol penetrates into the openings adjacent the tips of the crossbars and forms a continuous coating or bridge with the coating on opposite surfaces of this portion of the rack. The continuous coating is most clearly shown in FIG. 4. The bridge also provides for excellent metal-plastisol mechanical adhesion adjacent the tips and eliminates the problem of plastisol peel-off at the rack tips.

A rack prepared in accordance with the foregoing description containing four holes as shown in FIG. 3 was used to plate an automotive reflector bezel molded from ABS (acrylonitrile-butadiene-styrene) plastic. The plating cycle through the various pre-plating and plating baths was as follows:

| Bath | Time, min. |
|---|---|
| Etch | 6-9 |
| Neutralizer | 1-3 |
| Catalyst | 1-3 |

-continued

| Bath | Time, min. |
|---|---|
| Accelerator | 1-3 |
| Electroless Nickel | 6-12 |
| Copper Strike | 1-5 |
| Semi-Bright Nickel | 12-24 |
| Bright Nickel Plate | 6-12 |
| Dur-Ni (trademark) Nickel Plate | 1-2 |
| Chrome Plate | 3-5 |
| Rack Chrome Strip | 5-10 |
| Rack Nickel & Copper Strike | 12-36 |

The rack of the above example gave better service in terms of faster racking, better plating, longer rack life, lower maintenance cost, higher quality work, reduced rejects and lower total plating cost than conventional racks. Racks of conventional design have a life of slightly over a month in continuous use. The rack of the foregoing example was still in excellent condition after three months of continuous use.

I claim:

1. In an electroplating rack composed of an electrically conductive metal coated with an insulating coating, said rack having tips at extremities thereof, said tips being uncoated to provide electrical contact for a part being plated, the improvement in which the portion of the rack adjacent the tip has at least one opening therein through said rack, said opening being coated with said insulating coating, such that a continuous coating is formed with the coating on the opposite surfaces of said portion of the rack.

2. The electroplating rack of claim 1 in which said opening comprises a plurality of holes adjacent the tip thereof.

3. The electroplating rack of claim 2 in which said plurality of holes are of a diameter sufficient to be penetrated and completely coated with said insulating coating.

4. The electroplating rack of claim 3 in which said plurality of holes are spaced as close as possible to said tip without structurally impairing the ability of said rack to perform its electroplating function.

5. The electroplating rack of claim 1 in which said insulating coating is a polyvinyl chloride plastisol.

6. The electroplating rack of claim 1 in which the rack is of the frame type having a series of crossmembers spaced along and extending from a vertical trunk, the tips being at the extremities of each of said crossmembers.

* * * * *